United States Patent [19]

Hollstein et al.

[11] Patent Number: 4,630,777

[45] Date of Patent: Dec. 23, 1986

[54] POWDER SPRAY GUN

[75] Inventors: Thomas E. Hollstein; James J. Turner, both of Amherst; Douglas C. Mulder, Wellington; David E. O'Ryan, Avon Lake, all of Ohio

[73] Assignee: Nordson Corporation, Amherst, Ohio

[21] Appl. No.: 814,273

[22] Filed: Dec. 20, 1985

Related U.S. Application Data

[63] Continuation of Ser. No. 583,898, Feb. 27, 1984, abandoned.

[51] Int. Cl.[4] ..... B05B 5/04

[52] U.S. Cl. ..... 239/707; 239/698; 239/520

[58] Field of Search ..... 239/3, 690, 697, 698, 239/706, 707, 708, 390, 391, 520

[56] References Cited

U.S. PATENT DOCUMENTS

| | | | |
|---|---|---|---|
| 515,837 | 3/1894 | Mullaney | 239/520 |
| 1,686,004 | 10/1928 | Hottinger | 239/391 |
| 2,044,778 | 6/1936 | Halstead . | |
| 2,214,035 | 9/1940 | Tracy . | |
| 2,306,711 | 12/1942 | Payne, Jr. | 239/520 |
| 2,429,299 | 10/1947 | Serafinovitch . | |
| 2,959,353 | 11/1960 | Croskey et al. | 239/707 |
| 3,108,022 | 10/1963 | Church . | |
| 3,155,545 | 11/1964 | Rocks et al. . | |
| 3,195,264 | 7/1965 | Ward, Jr. | 239/3 |
| 3,233,831 | 2/1966 | Fraser . | |
| 3,248,606 | 4/1966 | Fraser . | |
| 3,263,127 | 7/1966 | Point et al. . | |
| 3,268,171 | 8/1966 | Walberg | 239/707 |
| 3,317,138 | 5/1967 | Fraser . | |
| 3,540,653 | 11/1970 | Fabre . | |
| 3,590,318 | 6/1971 | Probst et al. | 239/706 |
| 3,625,424 | 12/1971 | Mantica | 239/3 |
| 3,661,624 | 5/1972 | Versoy et al. . | |
| 3,682,384 | 8/1972 | Suisse . | |
| 3,687,706 | 8/1972 | Stanley et al. . | |
| 3,689,311 | 9/1972 | Loeffler et al. . | |
| 3,709,434 | 1/1973 | Gebhardt et al. . | |
| 3,746,254 | 7/1973 | Duncan et al. . | |
| 3,777,705 | 12/1973 | Harris et al. . | |
| 3,802,908 | 4/1974 | Emmons . | |
| 3,873,024 | 3/1975 | Probst . | |
| 3,903,321 | 9/1975 | Schaad | 239/698 |
| 3,924,562 | 12/1975 | Harris et al. . | |
| 3,937,401 | 2/1976 | Luderer et al. | 239/707 |
| 3,977,607 | 8/1976 | Kobayashi et al. | 239/697 |
| 4,072,129 | 2/1978 | Bright et al. | 239/697 |
| 4,109,861 | 8/1978 | McHugh | 239/707 |
| 4,128,078 | 12/1978 | Stoltz et al. . | |
| 4,245,551 | 1/1981 | Berkmann . | |
| 4,489,893 | 12/1984 | Smead | 239/707 |

FOREIGN PATENT DOCUMENTS

| | | | |
|---|---|---|---|
| 243953 | 4/1965 | Austria | 239/706 |
| 2402209 | 7/1975 | Fed. Rep. of Germany | 239/706 |

OTHER PUBLICATIONS

Sketch and photograph of Ransburg powder spray gun.

*Primary Examiner*—Joseph F. Peters, Jr.
*Assistant Examiner*—Michael J. Forman
*Attorney, Agent, or Firm*—Wood, Herron & Evans

[57] ABSTRACT

An electrostatic spray gun for spraying solid particulate powder materials while entrained in a gas medium, including an electrically non-conductive housing having an electrode extending forwardly therefrom and a straight electrically non-conductive powder transport tube adjustably and replaceably mounted within the housing so as to enable the discharge end of the tube to be positionably adjusted relative to the electrode or to be replaced with a tube of differing internal diameter so as to vary the transport velocity at which the powder is emitted from the discharge end of the tube.

1 Claim, 3 Drawing Figures

POWDER SPRAY GUN

This application is a continuation of application Ser. No. 583,898 filed 2-27-84 now abandoned.

This invention relates to electrostatic powder spray systems and more particularly to an improved powder spray gun for use in such systems.

Electrostatic powder spray systems operate on the principle of transporting a finely divided powder, generally on the order of 150 mesh, to a spray gun or spray head while the powder is entrained in an air or gaseous stream. The air entrained powder is transferred from the nozzle of the gun to a target article or substrate by an electrostatic charge applied to the powder and an effectively oppposite charge on the substrate. Once applied to the substrate, the powder is generally heated and melted so as to adhere the powder to the substrate as a film when the molten powder subsequently cools.

A characteristic of nearly all electrostatic powder spray applications is that less than half of all the sprayed powder adheres to the target article or substrate. The oversprayed powder thus must generally be collected, cleaned, and recycled in order for a powder spray system to operate efficiently and economically. Generally, the cost of collecting and recycling the powder is substantially greater than the cost of initially applying the powder. Consequently, it is very important to the economy of powder spray systems that as high a percentage as possible of the initial sprayed powder be adhered to the target article or substrate so that a minimum of the sprayed powder need be recycled or lost if the powder is not to be recycled.

The efficiency or percentage of sprayed powder which adheres to the target is a function of many variables, including the size and density of the sprayed powder, the velocity of the air stream in which the powder is ejected from the spray gun, the charge applied to the powder, and the configuration of the powder spray pattern.

It is difficult with existing powder spray guns to convert from one powder to another or from one powder spray pattern to another because each application requires a different combination of spray nozzle, air flow capacity and electrostatic charge to optimize the percentage of sprayed powder adhered to the substrate. Presently existing powder spray guns do not lend themselves to rapid adjustment of all of these variables and often require replacement of one gun with another in order to change from one powder to another or from one spray pattern to another.

It has therefore been one objective of this invention to provide an improved powder spray gun which lends itself to rapid and inexpensive conversion from the spraying of one powder to another or from one spray pattern to another.

Still another objective of this invention has been to provide an improved spray gun wherein the volume and velocity of powder transport air may be easily and inexpensively varied so as to optimize the powder ejection rate from the gun.

Many powder spray guns now in operation are characterized by uneven powder flow from the nozzle of the gun or an uneven distribution of powder within the pattern emitted from the nozzle of the gun. It has therefore been still another objective of this invention to provide a powder spray gun which has an even flow of powder from the nozzle of the gun and an even distribution of powder within the pattern emitted from the nozzle of the gun.

These objectives are achieved and this invention is in part predicated upon the concept of providing a powder spray gun wherein the powder is transported through a straight replaceable powder transport tube of the gun. The replaceable tube is secured within the housing of the gun by an infinitely adjustable locking element in such a manner that the tube with its attached nozzle may be easily adjusted in position or replaced with a different tube of a different inside diameter. By utilizing a variety of different powder tubes, each one of which has a different inside diameter, the transport velocity of powder emitted from the gun may be easily varied and optimized for a particular discharge rate and density of powder. The adjustable securement of the powder transport tube relative to the gun housing is such that the tube with its attached nozzle may be varied in location relative to a powder charging electrode of the gun so as to optimize the charge applied to powder ejected from the nozzle at the end of the tube.

We have found that optimal application of a sprayed powder to a substrate is a function not only of the velocity at which the powder emerges from the nozzle of the gun, but also the electrostatic charge applied to that powder. We have further found that the first of these two characteristics, i.e. the powder velocity at exit from the gun is a function of the internal diameter of the tube through which the powder is transported and whether that diameter is straight or curved and whether it varies from one end of the gun to the other. Optimally, that diameter should be straight and should be of a fixed diameter from one end to the other of the gun. Additionally, the discharge end of the tube, or the nozzle attached to the discharge end of that tube, should be adjustable relative to an electrode operable to apply a charge to the powder emitted from the nozzle of that tube.

According to the practice of this invention, the powder spray gun includes a straight powder transport tube through which powder is transported from the input end of the gun to the discharge end. This gun has an electrode mounted externally of the gun nozzle. The powder transport tube is adjustable within the gun and thereby positionable relative to the electrode so as to enable the gun nozzle to be positioned in an optimal location relative to the powder charging electrode. Furthermore, according to the practice of this invention, the powder transport tube is easily replaceable with a different tube of a different internal diameter so as to enable powders of varying characteristics to be sprayed from the gun with an optimal transport velocity as the powder is emitted from the gun.

The powder spray gun of this invention which accomplishes these objectives comprises an electrically non-conductive housing within which there is adjustably mounted a replaceable straight powder transport tube. This tube is adjustable relative to the discharge end of the gun and is so mounted within the gun as to be easily replaceable. A discharge nozzle or a powder deflector may alternatively be mounted in the discharge end of the powder transport tube.

The housing of the gun includes a bore or tube within which there is mounted an electrical resistor. This electrical resistor is connected at one end to an electrical cable and is connected at the other end to a powder charging electrode. This electrode is mounted externally of the nozzle or discharge end of the powder transport tube so that the transport tube may be adjusted relative to the electrode and thereby the charge applied to the electrode may be optimized for any particular spray pattern emitted from the gun.

The primary advantage of this gun is the ease with which it facilitates replacement and adjustment of a straight powder transport tube within the gun. Additionally, this gun has the advantage of enabling the nozzle of the gun to be easily adjustably positioned relative to the electrode of the gun.

These and other objects and advantages of this invention will be more readily apparent from the following description of the drawings in which.

The powder spray gun of this invention is intended for use as a part of a powder spray system, such as that disclosed in Berkmann U.S. Pat. No. 4,245,551. Within such a system air entrained powder is supplied to a powder spray gun through a supply hose while simultaneously, a very high voltage electrical charge is supplied to the gun from a source of electrical power. The electrostatic spray gun is operative to dispense the air entrained powder in a predetermined pattern while simultaneously applying a charge to the powder. The electrical charge then is operative to transport the powder from the nozzle of the gun to a target article or substrate which is of an opposite charge from that applied to the powder by the gun. Generally, a negative charge is applied to the powder by the electrostatic spray gun and the target article or substrate to which the powder is to be applied is grounded so that the powder is attracted to the article and adheres thereto, as a consequence of the charge on the powder.

Figure 1:
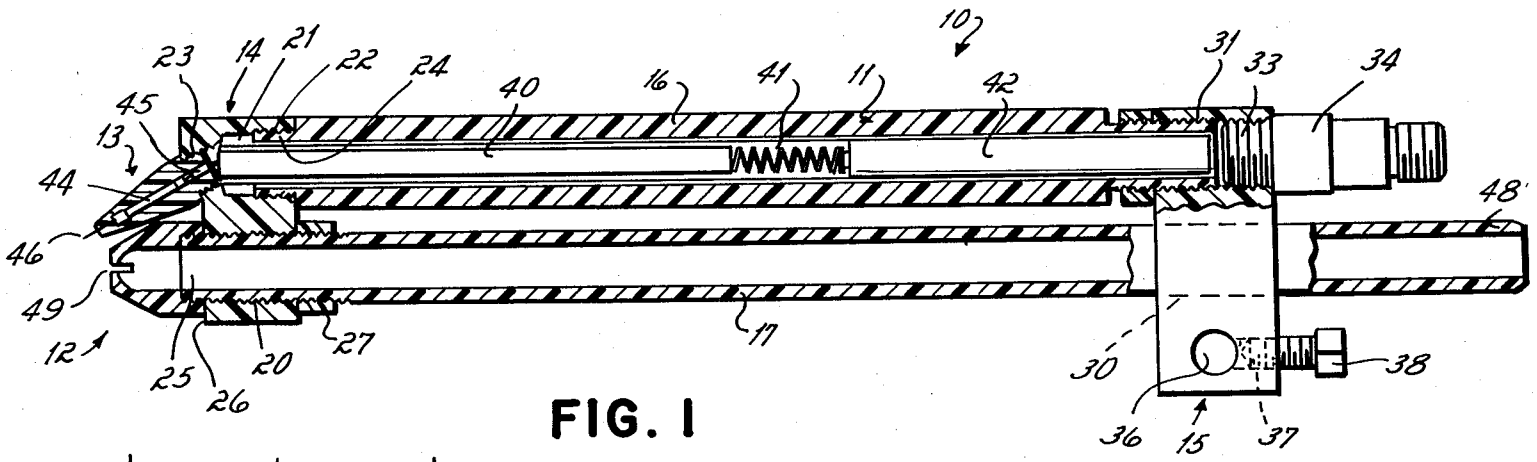
FIG. 1 is a cross sectional view through the electrostatic powder spray gun incorporating the invention of this application.

Referring first to FIG. 1, there is illustrated a first embodiment of a powder spray gun 10 incorporating the invention of this application. This powder spray gun comprises a housing 11 upon which there is mounted a nozzle 12 and an electrode support 13. The housing 11 comprises a pair of spaced mounting blocks 14 and 15 between which there are supported a pair of tubes 16 and 17. The uppermost one of these tubes is a resistor support tube 16 and the lowermost tube is a powder transport tube 17. Components 14, 16 and 17 are electrically nonconductive, while component 15 is electrically conductive to provide conductance to ground.

The forwardmost one of the mounting blocks 14 has a lower threaded through-bore 20 therein which may be threaded and an upper blind recess 21. The blind recess 21 is threaded as indicated at 22. Intersecting this blind recess 21 there is an angled threaded bore 23. The electrode support 13 is threaded into the bore 23 and the forward threaded end 24 of the resistor support tube 16 is threaded into the threaded section 22 of the recess 21. The threaded forward end 25 of the powder transport tube 17 is threaded into and through the threaded bore 20 of the mounting block 14 so that the forwardmost end 25 of the powder transport tube 17 extends forwardly beyond the front face 26 of the mounting block 14. The nozzle 12, which is a conventional slotted nozzle and is threaded onto this forwardmost end 25 of the powder transport tube 17. The powder transport tube 17 is locked in an adjusted position relative to the mounting block 14 by a jam nut 27 threaded over the rearwardmost threaded portion of the threaded forward end 25 of the powder transport tube 17.

The rear mounting block 15 is provided with a pair of through-bores 30, 31. The powder transport tube 17 extends through the lowermost one of these through-bores. The uppermost bore 31 is threaded for reception of the threaded rear end of the resistor support tube 16 and for reception of the threaded forward end 33 of a cable adapter 34. The rear end of the cable adapter 34 is also threaded for connection to a conventional electrical shielded cable (not shown).

Extending transversely through the rear mounting block 13 there is a transverse bore 36. This transverse bore 36 is intersected by a threaded bore 37 within which there is a set screw 38. The transverse bore 36 enables the rear mounting block 15 and thus the gun 10 to be secured to a mounting rod and fixed thereon by the set screw 38 as is conventional in this art.

Mounted internally of the resistor support tube 16 there is an electrical resistor 40. At the rear, this resistor 40 is connected via an electrically conductive spring 41 to an insulated electrical cable 42 contained internally of a conventional shielded cable (not shown) adapted to be connected to the cable adapter 34.

The forward end of the resistor 40 is electrically connected to a smaller resistor 44 contained internally of the electrically non-conductive casing of the electrode support 13. This small resistor 44 is connected via a conventional connector 45 to the forward end of the large resistor 40. At its forward end, the small resistor 44 is attached to the powder charging electrode 46 which extends forwardly beyond the forward end of the casing of electrode support 13. When an electrically shielded cable (not shown) is connected to the cable adapter 34, electrical contact is established between the conductor contained within the electrical insulated cable 42 of the shielded cable (not shown) and the electrode 46 via the spring 41, the resistor 40, the connector 45, and the small resistor 44.

When a source of air entrained powder, such as a conventional powder feed hopper, is connected via a hose (not shown) to the rearward end 48 of the powder transport tube 17, air entrained powder may be transported through the tube and ejected from an orifice 49 in the forward end of the nozzle 12. In the illustrated embodiment, the nozzle 12 is a conventional slotted nozzle but any type of powder spray nozzle may be utilized in the practice of this invention. The powder ejected from the nozzle orifice 49 is electrically charged during the course of passage through an electrostatic field created by the electrode 46. That powder then adheres to an effectively oppositely charged substrate (not shown) toward which the powder is ejected.

It is important to the use of a powder spray gun that the powder ejected from the nozzle of the gun not have too great a velocity imparted to it so that it sprays over and past or bounces off of the substrate toward which it is ejected. Alternatively, it is important that the powder has sufficient velocity that it does not fall out of the airstream and collect either in the powder transport tube 17 or in the vicinity of the nozzle orifice 49. Furthermore, it is important that the nozzle orifice 49 be positioned relative to the electrode 46 so that the charge applied to the powder emerging from the nozzle is optimized. We have found that if the relative position between the nozzle orifice and the electrode 46 is infinitely adjustable, the nozzle orifice may be positioned so as to optimize the charge applied to the powder by the electrode 46. We have also found that the inside diameter of the powder transport tube 17 can materially effect the transport velocity of powder emerging from the nozzle 12 of the gun. Therefore, the gun 10 described hereinabove may be constructed so as to facilitate longitudinal adjustment of the powder transport tube 17 relative to the supporting block 14, and consequently relative to the electrode 46 mounted within that block 14. This gun also facilitates replacement of the powder transport tube 17 so that tubes of varying inside diameters may be utilized and interchanged one with the other. To that end, all that is required to replace a tube 17 is to remove the nozzle 12 from the end of the tube, unthread, and then pull the tube 17 rearwardly until the tube is withdrawn from the forward and rear mounting block 14, 15. The jam nut 27 may then be removed and applied to another replacement tube of differing inside diameter. The replacement tube may then be inserted through the bore 30 in the rear mounting block and threaded into the bore 20 until the jam nut 27 engages the rearward face of the mounting block 14. The nozzle 12 may then be threaded onto the forward end of the powder transport tube and the nut 27 adjusted until the orifice 49 of the nozzle 12 is properly positioned relative to the electrode 46.

As an alternative to replacing the complete powder transport tube 17, an insert tube (not shown) may be inserted into the tube 17 so as to effectively change the inside diameter of the tube 17 without replacing it in the mounting blocks 14, 15. Such an insert tube would be the same length as the transport tube 17 (or longer to facilitate connection to the powder hose) and would have an outside diameter approximately the same diameter as the inside diameter of the transport tube 17. It would have an inside diameter of the same dimension from one end to the other but the inside diameter would, of course, be less than the inside diameter of the tube 17 within which such an insert tube would be mounted. Such an insert tube would also be made from electrically non-conductive material.

Figure 2:
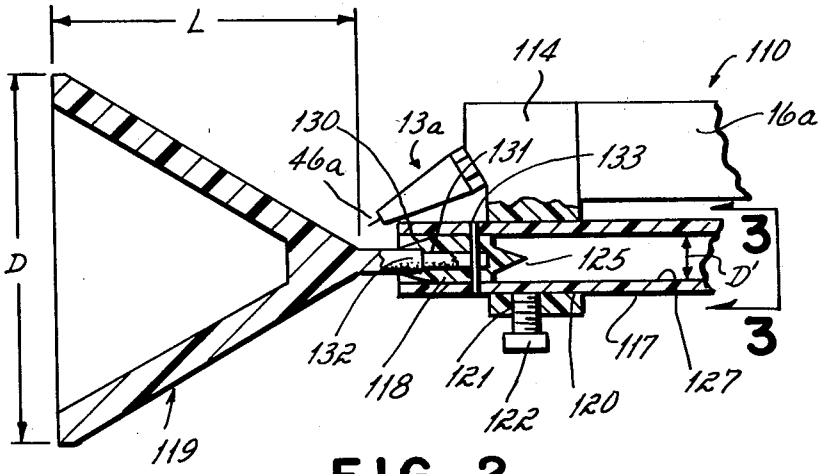
FIG. 2 is a cross sectional view through the discharge end of a second modification of the gun incorporating the invention of this application.
Figure 3:
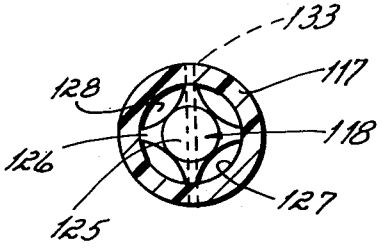
FIG. 3 is a cross sectional view taken on line 3—3 of FIG. 2.

With reference now to FIGS. 2 and 3, there is illustrated a second embodiment of this invention. In this embodiment those components of the gun which are identical to the components of the embodiment illustrated in FIG. 1 have been given the same numerical designation as is used in FIG. 1, except that in this embodiment the numeral is followed by the letter "a".

In general, the embodiment illustrated in FIG. 2 is identical to the embodiment illustrated in FIG. 1, except that it differs in the configuration of the powder transport tube nozzle and in the manner in which the powder transport tube 117 is adjusted relative to the forward mounting block 114. This embodiment also differs from the embodiment illustrated in FIG. 1 in that there is a deflector mounting insert 118 located within the forward end of the powder transport tube 117 and a conical powder deflector 119 extending forward of the gun outlet orifice.

In the embodiment of FIGS. 2 and 3 the powder transport tube is adjustable relative to the mounting block 114 as a consequence of the tube 117 being slideable within a smooth bore 120 of the mounting block 114. This bore 120 is intersected by a threaded bore 121 within which a set screw 122 is mounted. After being positioned within the bore 120, the powder transport tube 117 is secured or locked in an adjusted position by tightening the set screw 122. This results in the discharge end of the powder transport tube being secured in an adjusted position relative to the electrode 46*a*.

With reference to FIGS. 2 and 3 it will be seen that the deflector mounting insert 118 is generally shaped as a cylinder having a cone shaped rear end 125 and four flutes 126 extending radially from the cylindrical center section. The outer edges of these flutes 126 engage the inside wall 127 of the powder transport tube 117 so as to define four air flow passages 128 between the flutes 126.

The forward end of the deflector mounting insert 118 is tapered as indicated at 130. Additionally, the forward end of the insert is provided with a blind recess 131 within which the rearward cylindrical end 132 of the deflector 119 is mounted.

The deflector is fixedly secured to the powder transport tube 117 by means of a pin 133 which extends transversely through the powder transport tube 117, the insert 118 and the cylindrical end 132 of the deflector 119. As a consequence of this mounting, adjustment of the powder transport tube 117 relative to the mounting block 114 effects adjustment of the deflector 119 relative to the electrode 46*a*. It has been found that this adjustability of the deflector 119 relative to the electrode 46*a*, as well as the positioning of the electrode 46*a* behind rather than forwardly or internally of the deflector, optimize the electrical charge which may be applied to powder by the electrode. Additionally it has been found that if the deflector has a relatively long length dimension L of 2 inches to 5 inches, for example, and a relatively large diameter dimension D of 2 inches to 5 inches, for example, the powder pattern generated by the gun 110 may be optimized. The large diameter dimension D of the deflection is at least four and preferably six times the internal diameter D' of the powder transport tube 117.

In practice, air entrained powder is passed through the powder transport tube 117 of the gun 110 and the four passages 128 surrounding the deflector mounting insert 118 in the discharge end of the tube. As the powder emerges from the gun it picks up an electrical charge from the electrode 46*a*. It then engages and passes over the conically shaped deflector 119 so as to have a generally conical shaped pattern imparted to the powder. We have found that dividing the flow of air entrained powder as it emerges from the gun via the deflector mounting insert 118, has the effect of stabilizing the powder pattern ejected from the gun. In the absence of the insert 118, the powder has a tendency to swirl as it emerges from the gun. This swirling of the powder has a detrimental effect upon the sprayed pattern. Additionally, we have found that the application of a deflector in front of the insert and in front of the electrode 46*a* materially improves the pattern sprayed by the gun. Additionally, a very large deflector located forwardly of the electrode 46*a*. has been found to improve the spray pattern of the gun. Heretofore, it has been common practice to utilize relatively small deflectors and to position them alongside or rearwardly of the powder charging electrode. Our experience has been that a large deflector in combination with an electrode located rearwardly of the deflector results in better spray patterns and a more effective charge being applied to the powder.

The gun 10 of this invention has been described as having the electrode 46*a* mounted external to and independently of the nozzle 12 or deflector 119 so as to enable the nozzle or deflector to be adjusted relative to the electrode. In some applications though, we have found that the electrode may be completely omitted from the gun since the tribo-electricity may be sufficient to attract the powder from the gun to the target article and then to adhere the powder to the article. Specifically, we have found such tribo-electricity to be sufficient in this gun when the gun is used to spray thermoplastic powders.

While we have described only two embodiments of our invention, persons skilled in the art to which this invention pertains will appreciate numerous changes and modifications which may be made without departing from the spirit of this invention. Therefore, we do not intend to be limited except by the scope of the following appended claims:

Having described our invention we claim:

1. An electrostatic spray gun for spraying solid particulate powder materials comprising:

an electrically non-conductive housing, said housing comprising a pair of spaced mounting blocks and a pair of parallel tubes extending between said mounting blocks, one of said mounting blocks being spaced forwardly of the other, the forwardmost mounting block having an electrode extending forwardly therefrom, a first one of said pair of parallel tubes being fixedly mounted to said forwardmost mounting block, an electrical resistor mounted within said first one of said pair of tubes, said electrical resistor being electrically connected to said electrode, the second one of said pair of tubes being of adjustably mounted in said forwardmost mounting block, said second one of said pair of tubes being a straight powder transport tube, said powder transport tube having an inlet end and a forward outlet end, nozzle means mounted to the forward outer end of the powder transport tube, locking means for removably securing said powder transport tube and said nozzle means in an adjustable position relative to said forwardmost mounting block and said forwardly extending electrode, said first one of said pair of parallel tubes being fixedly mounted in the rearwardmost of said mounting blocks, said powder transport tube being slideably received in a bore of said second mounting block so as to facilitate removal and replacement of said powder transport tube from said mounting blocks, and means for supporting said electrostatic spray gun from said second mounting block.

* * * * *